US010077668B2

(12) United States Patent
Doi

(10) Patent No.: US 10,077,668 B2
(45) Date of Patent: Sep. 18, 2018

(54) GAS TURBINE ENGINE

(71) Applicant: HONDA MOTOR CO., LTD., Tokyo (JP)

(72) Inventor: Tatsuo Doi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 699 days.

(21) Appl. No.: 14/497,828

(22) Filed: Sep. 26, 2014

(65) Prior Publication Data

US 2016/0090852 A1 Mar. 31, 2016

(51) Int. Cl.
*F01D 11/00* (2006.01)

(52) U.S. Cl.
CPC ..... *F01D 11/001* (2013.01)

(58) Field of Classification Search
CPC ..... F01D 11/001; F01D 11/005; F01D 11/02; F01D 9/023; F01D 9/04; F01D 9/041; F01D 9/042; F01D 25/12
USPC ..... 60/266
See application file for complete search history.

(56) References Cited

U.S. PATENT DOCUMENTS 3,321,179 A * 5/1967 Johnson ..... F01D 5/081 415/115
5,224,822 A * 7/1993 Lenahan ..... C23C 30/00 415/177
5,252,026 A * 10/1993 Shepherd ..... F01D 5/081 415/115
5,545,004 A 8/1996 Ho et al.
5,967,745 A * 10/1999 Tomita ..... F01D 11/001 415/173.7
7,037,067 B2 * 5/2006 Okita ..... F01D 5/082 415/115
7,534,088 B1 * 5/2009 Alvanos ..... F01D 5/081 415/115
8,206,080 B2 * 6/2012 Howe ..... F01D 5/08 415/177
2014/0205441 A1 * 7/2014 Lee ..... F01D 11/001 415/170.1
2014/0205443 A1 * 7/2014 Lee ..... F01D 11/001 415/170.1

* cited by examiner

*Primary Examiner* — Phutthiwat Wongwian
*Assistant Examiner* — Loren Edwards
(74) *Attorney, Agent, or Firm* — Rankin, Hill & Clark LLP

(57) ABSTRACT

In a gas turbine engine, an annular intermediate-temperature space is formed by a first partition member extending from an inner platform radially inward and a second partition member having a radially inner end portion fixed to the first partition member and a radially outer end portion facing the inner platform, the inner platform being connected to radially inner ends of nozzle guide vanes of a turbine, and the intermediate-temperature space overlapping with the inner platform over substantially its axial entire length. The low-temperature space, supplied with a low-temperature air from a compressor, is formed on a radially inside of the second partition member. Therefore, a temperature of the intermediate-temperature space is maintained at an intermediate temperature between those of a combustion gas and the air, reducing a temperature difference of the inner platform from an outer platform and the vanes to reduce a thermal stress.

6 Claims, 3 Drawing Sheets

GAS TURBINE ENGINE

BACKGROUND OF THE INVENTION

Field of the Invention

The present invention relates to a gas turbine engine in which air compressed by a compressor is mixed with a fuel and combusted in a combustion chamber, and a turbine, which is supplied with a high-temperature combustion gas generated by combustion of the fuel, includes nozzle guide vanes on an upstream side and turbine blades on a downstream side.

Description of the Related Art

U.S. Pat. No. 5,545,004 describes a technique for protecting components of a gas turbine engine from thermal damage by preventing a high-temperature combustion gas flowing through a main flow passage 16 in a turbine duct of the engine from leaking to a low-temperature space 18 in the engine. In this technique, a high-temperature gas recirculation pocket 14 is formed on a radially inner side of an annular platform 25 of stator vanes (nozzle guide vanes) 24 disposed in the main flow passage 16 in the turbine duct. In this structure, the combustion gas flowing through the main flow passage 16 and air in the low-temperature space 18 are introduced into the high-temperature gas recirculation pocket 14, are mixed and circulated, and are then returned to the main flow passage 16, thereby preventing the hot gas from leaking directly to the low-temperature space 18.

SUMMARY OF THE INVENTION

Meanwhile, in the conventional gas turbine engine of this type, a combustion gas having a relatively high temperature comes into contact with the stator vanes, which exist in the main flow passage, and the platforms inside and outside in a radial direction, which support the stator vanes, while a cooling air having a relatively low temperature comes into contact with and cools an outer wall face of the platform inside in the radial direction (a wall face on the opposite side from the main flow passage). For this reason, a temperature of the platform inside in the radial direction becomes lower than temperatures of the stator vanes and the platform outside in the radial direction. Therefore, there is a problem in that this temperature gradient causes a large thermal stress to be generated particularly in connection portions between the stator vanes and the platform inside in the radial direction.

In the gas turbine engine described in U.S. Pat. No. 5,545,004, the high-temperature gas recirculation pocket 14 is formed on the radially inner side of the platform 25 of the stator vanes 24. For this reason, there is a possibility that existence of the high-temperature gas recirculation pocket 14, which is at an intermediate temperature due to mixing of the combustion gas and air, between the main flow passage 16 and the low-temperature space 18 reduce the temperature gradient, thereby reducing the thermal stress in the connection portions between the stator vanes 24 and the platform 25. However, the high-temperature gas recirculation pocket 14 faces only a part of an entire length of the platform 25 in an axial direction, and also a low-temperature air is introduced into an inside of the high-temperature gas recirculation pocket 14 for active cooling. For these reasons, the platform 25 is excessively cooled down, making it difficult to sufficiently reduce the temperature gradient, and there still is a concern that a large thermal stress is generated.

The present invention has been made in view of the above-described circumstances, and an object of the present invention is to reduce thermal stress acting on nozzle guide vanes of a turbine of a gas turbine engine, and on an inner platform supporting the nozzle guide vanes.

In order to achieve the object, according to a first feature of the present invention, there is provided a gas turbine engine in which air compressed by a compressor is mixed with a fuel and combusted in a combustion chamber, and a turbine, which is supplied with a high-temperature combustion gas generated by combustion of the fuel, includes nozzle guide vanes on an upstream side and turbine blades on a downstream side, wherein an annular intermediate-temperature space is formed by: an inner platform supporting radially inner ends of the nozzle guide vanes; a first partition member extending from the inner platform in a radially inward direction; and a second partition member having a radially inner end portion fixed to the first partition member and a radially outer end portion facing the inner platform, the intermediate-temperature space overlapping with the inner platform over substantially an entire length of the inner platform in an axial direction, and a low-temperature space, which is supplied with air from the compressor, is formed on a radially inner side of the second partition member.

According to the above-described feature, the air compressed by the compressor is mixed with the fuel and combusted in the combustion chamber, and the turbine, which is supplied with the high-temperature combustion gas generated by the combustion of the fuel, includes the nozzle guide vanes on the upstream side and the turbine blades on the downstream side. If the low-temperature space, which is supplied with a low-temperature air from the compressor, is formed directly on a radially inner side of the inner platform, which supports the radially inner ends of the nozzle guide vanes, a large thermal stress is generated in the inner platform and the nozzle guide vanes due to a difference in temperature from the high-temperature combustion gas flowing on the radially outer side of the inner platform. In contrast, the annular intermediate-temperature space is formed by: the first partition member extending from the inner platform in the radially inward direction; and the second partition member having the radially inner end portion fixed to the first partition member and the radially outer end portion facing the inner platform, the intermediate-temperature space overlapping with the inner platform over substantially the entire length of the inner platform in the axial direction, and the low-temperature space, which is supplied with the low-temperature air from the compressor, is formed on the radially inner side of the second partition member. Therefore, a temperature of the intermediate-temperature space is maintained at an intermediate temperature between a temperature of the combustion gas and a temperature of the air, making it possible to reduce the difference in temperature of the inner platform from an outer platform and the nozzle guide vanes, thereby reducing the thermal stress.

According to a second feature of the present invention, in addition to the first feature, a seal portion to prevent the combustion gas from leaking from a gap between the nozzle guide vanes and the turbine blades is constituted by inserting an upstream end portion of a platform of the turbine blades between a downstream end portion of the inner platform and a downstream end portion of the second partition member.

According to the above-described feature, since the seal portion is formed by inserting the upstream end portion of the platform of the turbine blades between the downstream end portion of the inner platform and the downstream end portion of the second partition member, it is possible to prevent the combustion gas from leaking from the gap between the nozzle guide vanes and the turbine blades. Here, amount of thermal expansion of the downstream end portion of the inner platform, which constitutes one of the lips of the seal portion, is large because the downstream end portion of the inner platform comes into contact with the combustion gas having a relatively high temperature, while amount of thermal expansion of the downstream end portion of the second partition member, which constitutes the other one of the lips of the seal portion, is small because the downstream end portion of the second partition member comes into contact with the low-temperature air. However, since the downstream end portion of the inner platform and the downstream end portion of the second partition member only face each other but are not fixed to each other, difference in the amount of thermal expansion is absorbed, and thermal stress is thus reduced.

Note that a high-pressure compressor 23 in an embodiment corresponds to the compressor of the present invention, a reverse-flow combustion chamber 29 in the embodiment corresponds to the combustion chamber of the present invention, a low-pressure turbine 32 in the embodiment corresponds to the turbine of the present invention, and a second low-temperature space 52 in the embodiment corresponds to the low-temperature space of the present invention.

The above-described and other objects, features, and advantages of the present invention will be made clear from the description of a preferred embodiment, which is described in detail with reference to the accompanying drawings.

BRIEF DESCRIPTION OF THE DRAWINGS

FIG. 1 is a view showing an entire structure of a twin spool turbofan engine;

FIG. 2 is a detailed view of a part indicated by 2 in FIG. 1; and

FIG. 3 is an enlarged view of a part indicated by 3 in FIG. 2.

DESCRIPTION OF THE PREFERRED EMBODIMENT

Hereinafter, an embodiment of the present invention will be described on the basis of FIG. 1 to FIG. 3.

Figure 1:
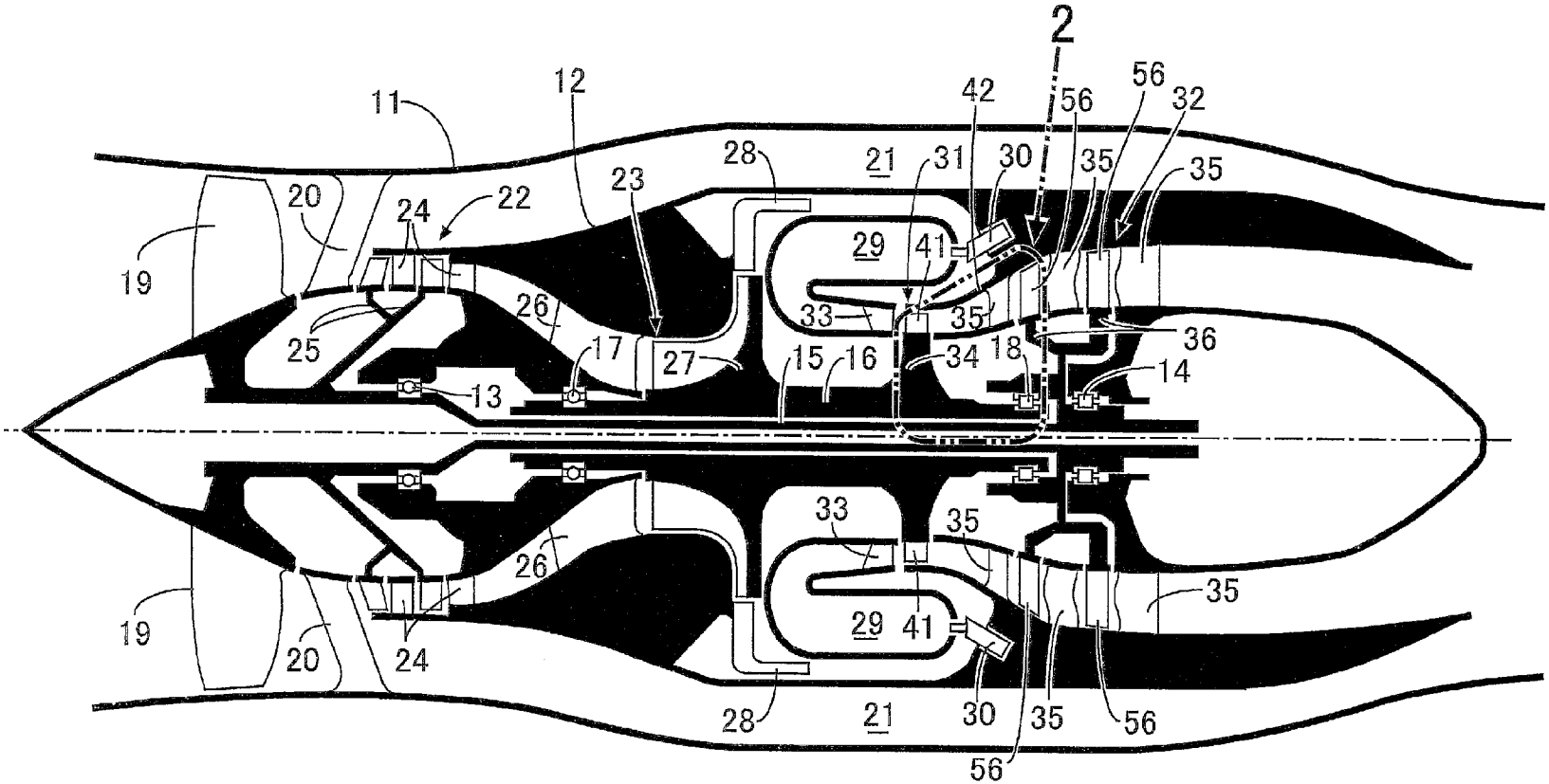
FIG. 1 to FIG. 3 illustrate an embodiment of the present invention.

As illustrated in FIG. 1, a twin spool turbofan engine for aircraft to which the present invention is applied includes an outer casing 11 and an inner casing 12. A front portion and a rear portion of a low-pressure shaft 15 are rotatably supported inside the inner casing 12 via a front first bearing 13 and a rear first bearing 14, respectively. A tubular high-pressure shaft 16 is relatively rotatably fitted on an outer periphery of an intermediate portion of the low-pressure shaft 15 in an axial direction. A front portion of the high-pressure shaft 16 is rotatably supported by the inner casing 12 via a front second bearing 17, and a rear portion of the high-pressure shaft 16 is rotatably supported by the low-pressure shaft 15 via a rear second bearing 18.

A front fan 19, which has blade ends facing an inner face of the outer casing 11, is fixed to a front end of the low-pressure shaft 15. Part of air sucked in by the front fan 19 passes through stator vanes 20 disposed between the outer casing 11 and the inner casing 12. Thereafter, a portion of the part of the air passes through an annular bypass duct 21 formed between the outer casing 11 and the inner casing 12 and is ejected rearward, while the other portion of the part of the air is supplied to an axial-flow low-pressure compressor 22 and a centrifugal high-pressure compressor 23 which are disposed inside the inner casing 12.

The low-pressure compressor 22 includes: stator vanes 24, which are fixed to an inside of the inner casing 12; and a low-pressure compressor wheel 25, which includes compressor blades on an outer periphery thereof and is fixed to the low-pressure shaft 15. The high-pressure compressor 23 includes: stator vanes 26, which are fixed to the inside of the inner casing 12; and a high-pressure compressor wheel 27, which includes compressor blades on an outer periphery thereof and is fixed to the high-pressure shaft 16.

A reverse-flow combustion chamber 29 is disposed rearward of a diffuser 28 connected to the outer periphery of the high-pressure compressor wheel 27. A fuel is injected into the reverse-flow combustion chamber 29 from a fuel injection nozzle 30. The fuel and the air are mixed and combusted inside the reverse-flow combustion chamber 29, and a combustion gas thus generated is supplied to a high-pressure turbine 31 and a low-pressure turbine 32.

The high-pressure turbine 31 includes: nozzle guide vanes 33, which are fixed to the inside of the inner casing 12; and a high-pressure turbine wheel 34, which includes turbine blades on an outer periphery thereof and is fixed to the high-pressure shaft 16. The low-pressure turbine 32 includes: nozzle guide vanes 35, which are fixed to the inside of the inner casing 12; and a low-pressure turbine wheel 36, which includes turbine blades on an outer periphery thereof and is fixed to the low-pressure shaft 15.

Accordingly, when the high-pressure shaft 16 is driven by a non-illustrated starter motor, the air sucked in by the high-pressure compressor wheel 27 is supplied to the reverse-flow combustion chamber 29 and is mixed with the fuel to be combusted, and the combustion gas thus generated drives the high-pressure turbine wheel 34 and the low-pressure turbine wheel 36. As a result, the low-pressure shaft 15 and the high-pressure shaft 16 are rotated to cause the front fan 19, the low-pressure compressor wheel 25, and the high-pressure compressor wheel 27 to compress the air, and supply the compressed air to the reverse-flow combustion chamber 29. Therefore, even after the starter motor is stopped, operation of the turbofan engine is continued.

During the operation of the turbofan engine, part of the air sucked in by the front fan 19 passes through the bypass duct 21 and is ejected rearward, thus generating main thrust particularly during low-speed flight. Meanwhile, the rest of the air sucked in by the front fan 19 is supplied to the reverse-flow combustion chamber 29 to be mixed with the fuel and combusted, drives the low-pressure shaft 15 and the high-pressure shaft 16, and then is ejected rearward to generate thrust.

Figure 2:
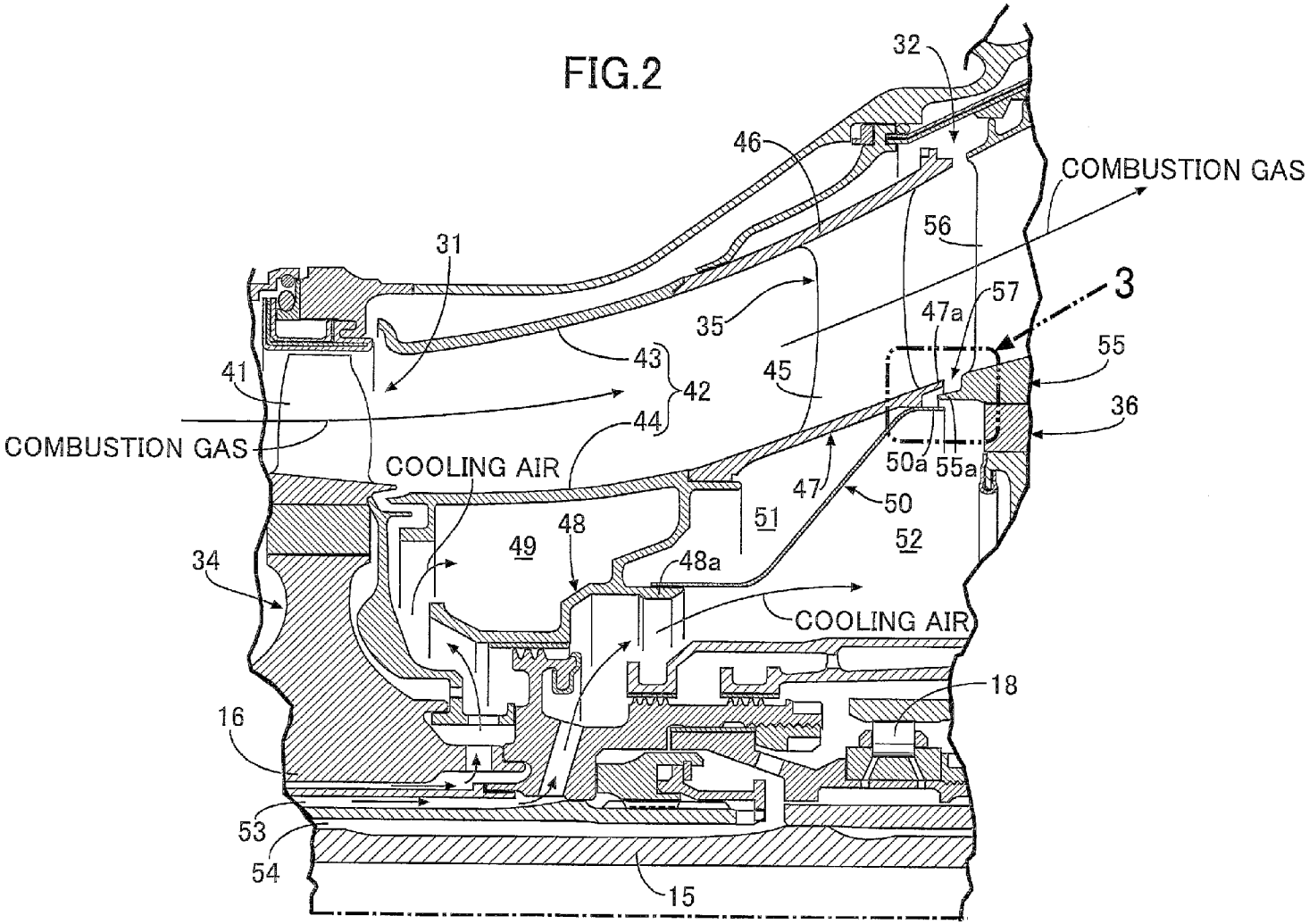

FIG. 2 is a detailed view illustrating a part of the turbofan engine from an outlet part of the high-pressure turbine 31 to an inlet part of the low-pressure turbine 32. A circular annular inter-turbine duct 42 to guide the combustion gas to the low-pressure turbine 32 is connected to a downstream side of high-pressure turbine blades 41 provided on the outer periphery of the high-pressure turbine wheel 34. The inter-turbine duct 42 is constituted of an outer duct 43 on an outer side in a radial direction and an inner duct 44 on an inner side in the radial direction. The nozzle guide vanes 35 of the low-pressure turbine 32 are constituted of: a plurality of vane bodies 45, which radially extend in the radial direction; an annular outer platform 46, which supports radially outer end portions of the vane bodies 45; and an annular inner platform 47, which supports radially inner end portions of the vane bodies 45. The outer platform 46 continues to a downstream side of the outer duct 43 while the inner platform 47 continues to a downstream side of the inner duct 44.

A first partition member 48 extends inward in the radial direction integrally from a downstream end of the inner duct 44 of the inter-turbine duct 42. An annular first low-temperature space 49 is defined between an inner peripheral face of the inner duct 44 and an outer peripheral face of the first partition member 48. In addition, one end of a second partition member 50 is joined to a flange 48*a* protruded on an intermediate portion of the first partition member 48. The other end of the second partition member 50 faces a downstream end of the inner platform 47 of the nozzle guide vanes 35 via a slight gap or in slight contact, so that a substantially closed annular intermediate-temperature space 51 is defined by the inner platform 47, the first partition member 48, and the second partition member 50. Moreover, a second low-temperature space 52 is defined on a radially inner side of the second partition member 50.

The high-pressure shaft 16, which supports the high-pressure compressor wheel 27 (see FIG. 1) and the high-pressure turbine wheel 34, is divided into a plurality of members, and a first air passage 53 and a second air passage 54, which extend in an axial direction, are formed between these members. The first air passage 53 and the second air passage 54 have upstream ends, which face an outlet of the high-pressure compressor wheel 27, and downstream ends, which communicate with the first low-temperature space 49 and the second low-temperature space 52, respectively.

Figure 3:
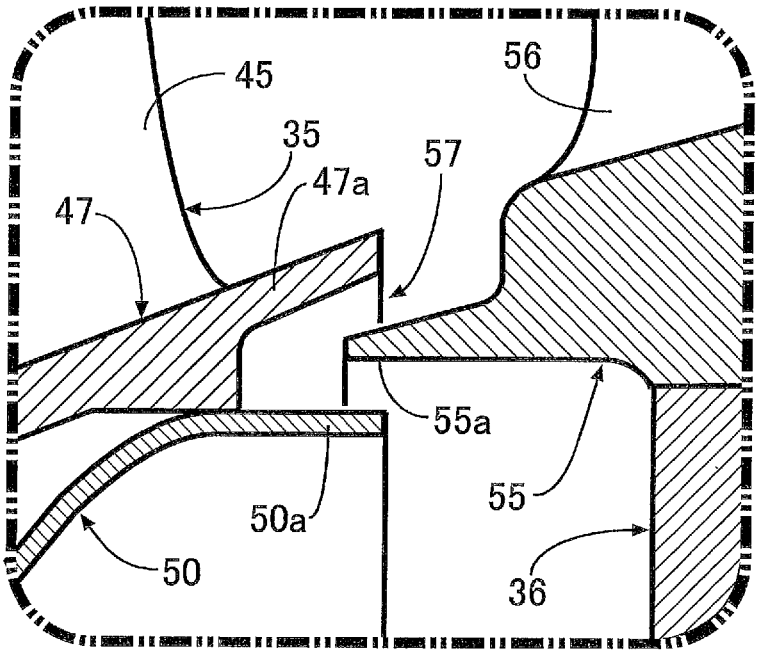

As illustrated in FIG. 2 and FIG. 3, an outer lip 47*a* protrudes from a downstream end of the inner platform 47, and an inner lip 50*a* protrudes from a downstream end of the second partition member 50 in such a manner as to face a radially inner side of the outer lip 47*a*. A plurality of low-pressure turbine blades 56 are radially supported by the outer periphery of the low-pressure turbine wheel 36 via a platform 55. A protrusion 55*a*, which protrudes from an upstream end of the platform 55, is fitted between the outer lip 47*a* and the inner lip 50*a* via a gap. The outer lip 47*a*, the inner lip 50*a*, and the protrusion 55*a* constitute a seal portion 57.

Next, operation of the embodiment of the present invention having the above-described configuration will be described.

The combustion gas generated by the combustion of a air-fuel mixture of the fuel and the air inside the reverse-flow combustion chamber 29 passes through the nozzle guide vanes 33 and the high-pressure turbine blades 41 of the high-pressure turbine 31, thereby driving the high-pressure shaft 16, and thereafter flows into the inter-turbine duct 42 and passes through the nozzle guide vanes 35 and the low-pressure turbine blades 56 of the low-pressure turbine 32 downstream of the inter-turbine duct 42, thereby driving the low-pressure shaft 15.

Inner wall faces of the outer platform 46 and the inner platform 47 of the nozzle guide vanes 35 disposed downstream of the inter-turbine duct 42 come into contact with the high-temperature combustion gas supplied from the reverse-flow combustion chamber 29, and thus are thermally expanded. On the other hand, a cooling air having a relatively low temperature, which is taken out from a downstream of the high-pressure compressor 23 in order to cool an inside of the gas turbine engine, is supplied to the first low-temperature space 49 and the second low-temperature space 52 through the first and second air passages 53, 54 formed inside the high-pressure shaft 16.

At this time, if the second partition member 50 and the intermediate-temperature space 51 do not exist, an outer wall face (a radially inner face) of the inner platform 47 comes into direct contact with and be cooled by the cooling air, and a large difference in temperature is generated between the outer platform 46 and the nozzle guide vanes 35, which are heated by the high-temperature combustion gas, and the inner platform 47, which is cooled by the low-temperature cooling air. As a result, there is a concern that a large thermal stress would act particularly on a connection portion between the nozzle guide vanes 35 and the inner platform 47.

However, according to this embodiment, the substantially closed intermediate-temperature space 51 is formed on the radially inner side of the inner platform 47 by the first partition member 48 and the second partition member 50. The temperature of the air inside the intermediate-temperature space 51 is maintained at an intermediate temperature between the temperature of the high-temperature combustion gas and the temperature of the low-temperature cooling air. Opposite faces of the inner platform 47 come into contact with the high-temperature combustion gas and the intermediate-temperature air, respectively, keeping the inner platform 47 from being excessively cooled, and accordingly, the temperature gradient is reduced, thereby reducing the thermal stress. In addition, opposite faces of the first partition member 48 and the second partition member 50, which define the intermediate-temperature space 51, come into contact with the intermediate-temperature air and the low-temperature cooling air, respectively, and accordingly, the temperature gradient is reduced, thereby reducing the thermal stress.

In particular, the intermediate-temperature space 51 is formed to overlap with the inner platform 47 over substantially the entire length of the inner platform 47 in the axial direction. This brings the outer wall face (the radially inner face) of the inner platform 47 uniformly into contact with the intermediate-temperature air, and thus makes the temperature of the inner platform 47 uniform in the axial direction, thereby making it possible to further reduce the thermal stress.

In addition, the seal portion 57 is constituted by fitting the protrusion 55*a* of the platform 55 of the low-pressure turbine blades 56 between the outer lip 47*a* on the downstream end of the inner platform 47 and the inner lip 50*a* on the downstream end of the second partition member 50. This makes it possible to prevent the combustion gas flowing through the low-pressure turbine 32 from leaking to the second low-temperature space 52. Here, the amount of thermal expansion of the inner platform 47, which comes into contact with the high-temperature combustion gas, is large while the amount of thermal expansion of the second partition member 50, which comes into contact with the low-temperature cooling air, is small. However, since the inner platform 47 and the second partition member 50 are not coupled to each other, but face each other to be movable relative to each other, stress due to the difference in the amount of thermal expansion is prevented from being generated in the section of the seal portion 57.

Although the embodiment of the present invention has been described so far, various modifications in design may be made without departing from the scope of the present invention.

For example, in the embodiment, among the nozzle guide vanes 35 disposed in two stages in the axial direction, the intermediate-temperature space 51 faces the inner platform 47 of the nozzle guide vanes 35 on the upstream side. However, the intermediate-temperature space 51 may face the inner platform 47 of any of the nozzle guide vanes 35.

What is claimed is:

1. A gas turbine engine in which air compressed by a compressor is mixed with a fuel and com busted in a combustion chamber, and a turbine, which is supplied with a high-temperature combustion gas generated by combustion of the fuel, includes nozzle guide vanes upstream from turbine blades, the gas turbine engine comprising:

an annular intermediate-temperature space formed by: an inner platform supporting radially inner ends of the nozzle guide vanes; a first partition member which is separately formed from the inner platform, and the first partition member being fixed to and extending from the inner platform in a radially inward direction; and a second partition member having a radially inner end portion fixed to the first partition member and a radially outer end portion contacting a downstream portion of the inner platform, the inner platform having an upstream end and a downstream end in a direction of combustion gas flow in an axial direction within the gas turbine engine, the upstream end and the downstream end of the inner platform being opposite to each other, and the downstream portion of the inner platform being disposed adjacent the downstream end, wherein the intermediate-temperature space is defined with a closed cross section and overlaps with the inner platform over a length of the inner platform between the upstream end of the inner platform and a point at which the radially outer end portion of the second partition member contacts the downstream portion of the inner platform, in the axial direction, such that the inner platform maintains uniform temperature along the axial direction thereof, the intermediate-temperature space is disposed between a first low-temperature space and a second low-temperature space, which are supplied with air from the compressor, in the direction of combustion gas flow in the axial direction within the gas turbine engine, the first low-temperature space is formed on an upstream side of the intermediate-temperature space in the direction of combustion gas flow in the axial direction within the gas turbine engine via the first partition member, and the second low-temperature space is formed on a radially inner side of the second partition member on a downstream side of the intermediate-temperature space in the direction of combustion gas flow in the axial direction within the gas turbine engine via the second partition member, and the first partition member defines a portion of a boundary of the first low-temperature space and is disposed to directly contact low-temperature air in the first low-temperature space, and the second partition member defines a portion of a boundary of the second low-temperature space and is disposed to directly contact low-temperature air in the second low-temperature space.

2. The gas turbine engine according to claim 1, wherein a seal portion to prevent the combustion gas from leaking from a gap between the nozzle guide vanes and the turbine blades is constituted by inserting an upstream end portion of a platform of the turbine blades between the downstream portion of the inner platform and a downstream end portion of the second partition member.

3. The gas turbine engine of claim 1, wherein the inner platform faces and maintains a sliding relationship with the radially outer end portion of the second partition member, without being coupled to the second partition member so that the inner platform and the second partition member are moveable relative to each other.

4. The gas turbine engine of claim 1, wherein opposite faces of the inner platform are disposed to respectively uniformly contact the high-temperature combustion gas and intermediate-temperature air within the intermediate-temperature space along an axial length of the nozzle guide vanes.

5. The gas turbine engine of claim 1, wherein the inner platform is formed along an entire axial length of the radially inner ends of the nozzle guide vanes.

6. The gas turbine engine of claim 5, wherein the inner platform extends beyond the radially inner ends of the nozzle guide vanes in the axial direction.

* * * * *